US005322294A

United States Patent [19]

Landfield

[11] Patent Number: 5,322,294

[45] Date of Patent: Jun. 21, 1994

[54] SHIPPING BOARD GAME

[76] Inventor: Michael Landfield, 965 Old Green Bay, Winnetka, Ill. 60093

[21] Appl. No.: 98,432

[22] Filed: Jul. 28, 1993

[51] Int. Cl.[5] ..... A63F 3/04

[52] U.S. Cl. ..... 273/254; 273/256

[58] Field of Search ..... 273/251, 252, 254, 256, 273/278

[56] References Cited

U.S. PATENT DOCUMENTS

| | | | |
|---|---|---|---|
| 4,445,692 | 5/1984 | Boyle | 273/256 |
| 4,928,967 | 5/1990 | Woodliff | 273/256 X |
| 5,118,115 | 6/1992 | Codinha | 273/256 X |

FOREIGN PATENT DOCUMENTS

| | | | |
|---|---|---|---|
| 2078118 | 1/1982 | United Kingdom | 273/256 |
| 2236059 | 3/1991 | United Kingdom | 273/278 |

*Primary Examiner*—William E. Stoll

*Attorney, Agent, or Firm*—Willian Brinks Hofer Gilson & Lione

[57] ABSTRACT

A board game having a playing surface incorporating a representation of land masses separated by oceanic expanses, with the latter divided into segmented movement areas, and further employing playing equipment for the purchase, shipment and sale of oil, freight and goods from one land mass to another.

7 Claims, 3 Drawing Sheets

| | OIL | FREIGHT | GOODS |
|---|---|---|---|
| $70 | CANADA | N. EUROPE | BRAZIL |
| $55 | | ALL OTHERS | |
| $30 | M.EAST<br>S.AFRICA | USA<br>JAPAN | GREENLAND<br>CANADA |

| SHIPS | BUILDINGS | BANKS | FINANCE |
|---|---|---|---|
| $50 | $20 | $30 | $5 |

SHIPPING BOARD GAME

FIELD OF THE INVENTION

This invention relates generally to a board game device, and more particularly to a board game arrangement having a playing surface incorporating a representation of land masses separated by oceanic expanses, with the latter divided into segmented movement areas, and further employing playing equipment for the purchase, shipment and sale of oil, freight and goods from one land mass to another.

BACKGROUND OF THE INVENTION

Board game devices using a game board are, of course, well known in the art. They commonly employ some kind of segmented pathway or gridwork over which playing pieces are moved incrementally, as by the roll of a die or some other chance device. In addition, board games have often incorporated playing cards which are employed in the course of play, such as to augment the movement of the playing pieces.

Board game devices utilize varying equipment and indicia, typically being specifically related to the theme or object of the particular game. The novelty of such game devices is virtually limitless, constrained only the imagination and some modicum of differentiation from the prior art.

SUMMARY OF THE INVENTION

The board game device of the present invention comprises a game board having a playing surface which has formed thereon a depiction of a plurality of landmasses separated from each other by oceanic expanses. Such a playing surface would preferably be representational of the planet earth. The oceanic expanses are divided into contiguous segments constituting discrete movement spaces in the play of the game, with some segments contiguous with an adjacent landmass.

A plurality of movable game pieces for movement over the oceanic expanses are provided. The game pieces are organized into sets bearing an identifying indicium for each set, such that each player will have his or her own identifiable set.

A set of currency, i.e., money, each item of currency bearing an indicium of value, is included for use in play. A random number generator, such as in the form of a spinner, is used for determining the extent of movement on a player's turn, among other things.

A set of price cards is provided each bearing varying indicia setting forth a value for a predetermined plurality of items, including product items. These price cards serve to establish a value for items to be purchased and sold, in accordance with play of the game. An indicium indicative of a product item, such as a marker or peg, is additionally provided to indicate the presence of a purchased product item.

A set of playing cards bearing varying indicia setting forth an action requirement is included. These playing cards are related in use to certain areas of the playing surface; for example, docking cards are associated with landmasses and ocean cards with the open sea areas of the playing surface. The action required by a card can be, for example, specified additional movement, penalties and rewards.

A set of static game pieces represent edifices which are emplaceable on a landmass in accordance with an exchange of currency related to a price card. For instance, a bank or building edifice can be purchased by a player and then placed at a spot on a landmass. The static game pieces are preferably arranged in subsets having identifying indicia for each set for each player.

A movable game piece, such as in the form of a ship, is advanced about the segments defined in the oceanic expanses in accordance with a random number generated by the random number generator, i.e., the spinner. The ships can be made specific to a particular product item to be associated with that ship, such that there are oil tankers, container ships and freighters for each player. A playing card is selected from the playing card set when a movable game piece lands upon a certain area, such as a segment adjacent a landmass or an open ocean segment, as when a move is terminated. Action dictated by the playing card is then taken.

The product items are associated with a movable game piece upon movement of the movable game piece to a segment contiguous with a landmass having an edifice emplaced thereon, such as an edifice owned by the player of that movable game piece. The product item is thereby associated with, or "loaded aboard," the movable game piece in accordance with an exchange of currency related to the value of that product item indicated on the price card then in play. A marker indicative of the presence of that product item on that ship can be emplaced on the ship.

The product-laden ship can then progress, in turn, across the oceanic expanse to a segment contiguous with another landmass, where that product item can thereafter become disassociated with the ship, i.e., sold. Again, the landmass where the ship has docked must have another edifice emplaced thereon, preferably again being owned by the player of that docked ship.

The amount for which the product is sold is determined in accordance with an exchange of currency related to the price card then in play. In the preferred form of the game board device, at least some of the product item values on a given price card are different as between identified landmasses. The objective is therefore to buy a product at one landmass for a stated value, and then progress to another landmass where it is sold for a higher value.

The game board device most preferably has price cards bearing values for product items denominated "oil", "freight" and "goods," and for other items denominated "ships" "buildings" "banks" and "finance". The static game pieces thereby represent buildings and banks. This form of the game board device requires the payment of a "finance" charge by an opposing player when his or her movable game piece occupies a segment contiguous with another landmass, upon which another player has emplaced a "bank."

In that most preferred form of the game board device, the playing cards bearing varying directions setting forth an action requirement includes a set of ocean cards, from which an ocean card is selected upon conclusion of movement of a movable game piece on a segment which is in the open ocean; and a set of docking cards, from which a docking card is selected upon conclusion of movement of a movable game piece on a segment which is contiguous with a landmass.

In addition, the spinner includes indicia respectively representing "lawsuit" and "price card" actions. The lawsuit action can result in an exchange of currency between selected game players based upon a predetermined mode of lawsuit outcome determination, such as whether a higher number is obtained on respective spins of the spinner by the "plaintiff" or "defendant." The monetary value of the outcome is preferably further related to the number of static game pieces possessed by the "plaintiff."

The price card action results in the selection of a new price card from the set of price cards. This introduces an element of random market value fluctuation in the play of the game.

The game board device can further have one or both of the sets of ocean and docking cards including indicia respectively representing the foregoing "lawsuit" and "price card" actions.

Play concludes when, for example, a predetermined sum of currency and/or assets is amassed by one player, or when all of the other players have lost their money.

The features and advantages of the present invention will be further understood upon consideration of the following detailed description of the invention taken in conjunction with the accompanying drawings, in which:

DETAILED DESCRIPTION OF AN EMBODIMENT OF THE INVENTION

Figure 1:
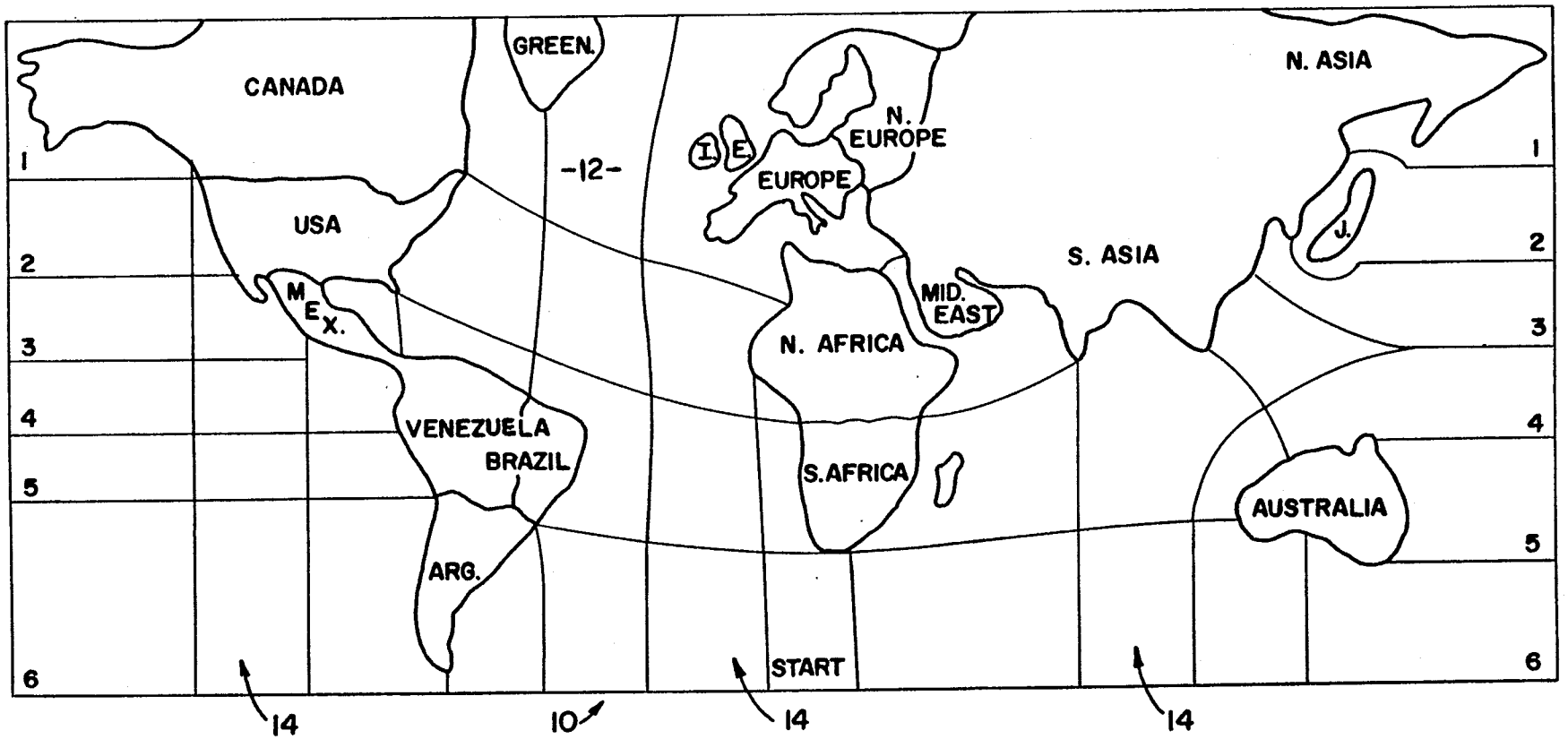
FIG. 1 is a plan view of a game board and playing surface made in accordance with the principles of this invention.

Referring now to FIG. 1, a preferred form of the game board is shown, being generally indicated at 10. The game board 10 may be constructed of cardboard, wood, pressed board or other suitable material, and in the described embodiment is planar in form.

Figure 2:
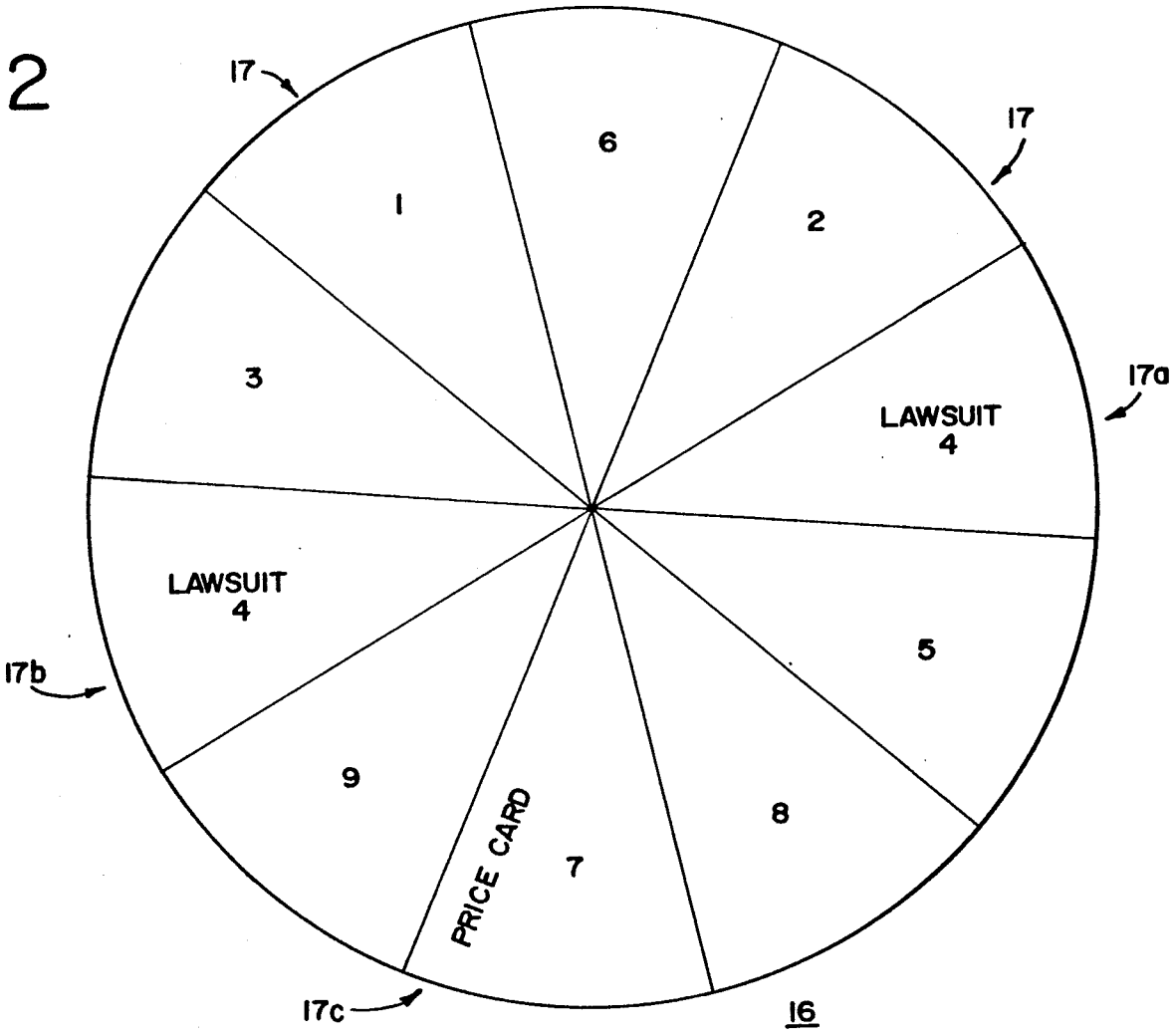
FIG. 2 is a plan view of a spinner for use with this invention.

The game board has a playing surface indicated generally at 12. The playing surface 12 comprises a depiction of the landmasses and oceanic expanses of the world. A gridwork of contiguous segments 14 is superimposed upon the oceanic expanses of the playing surface 12, with some of the segments 14 contiguous with the land masses of the playing surface 12 defining discrete paths of movement for a plurality of movable game pieces, to be more fully described below. Each segment 14 corresponds to one unit of movement. A random number generator in the form of a spinner, indicated generally at 16 in FIG. 2, is used to determine the number of units of movement for each turn by a given player. The spinner 16 is divided into pie-shaped segments bearing the numbers 1–9. Two of said segments 17*a* and 17*b* additionally respectively bear the legend "LAWSUIT," the function of which is described more fully below. Another segment 17*c* additionally bears the legend "PRICE CARD."

Figures 3, 4:
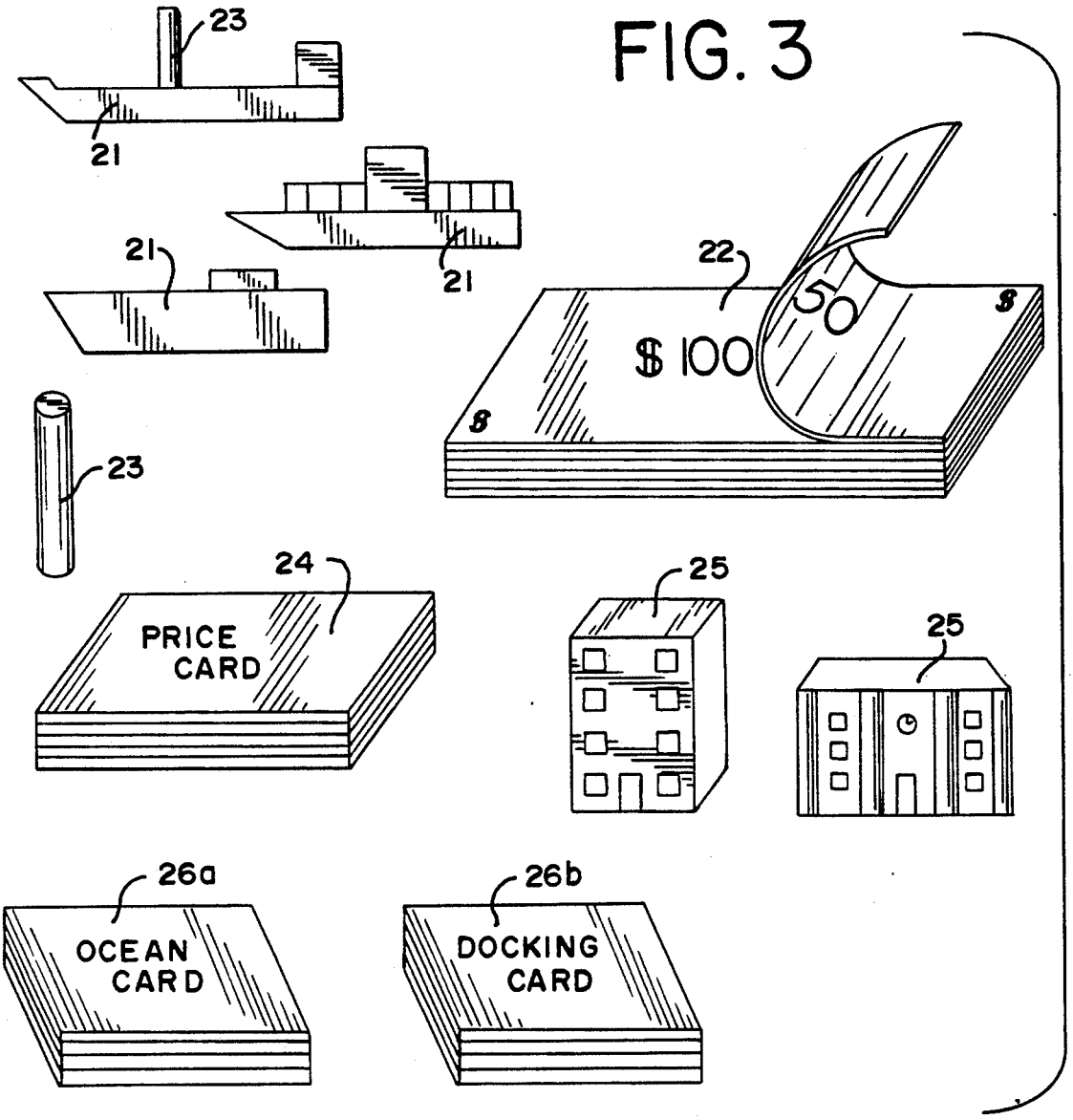
FIG. 3 is a representation of the game pieces, playing cards, and price cards for use with this invention.
FIG. 4 is a plan view of a price card for use with this invention.

Referring now to FIG. 3 the movable game pieces are indicated generally at 21. The movable game pieces 21 are divided into differently colored sets to allow each player to identify his or her own set. Each set of movable game pieces 21 is further divided into types specific to a particular product item. In this embodiment, the types include oil tankers, freighters and container ships.

A set of currency 22 is used by the players to purchase product items such as oil, goods and freight. Once a player has purchased a product item, a peg 23 is inserted in a hole in the movable game piece 21 to indicate that the commodity purchased has been "loaded" on that players movable game piece 21.

A set of price cards 24 (FIG. 4) is provided to determine the price at which product items may be purchased and sold in a given country. Static game pieces 25 depict buildings and banks which may be purchased at a price indicated on the price cards 24 and then emplaced on the land masses of the playing surface 12. The game pieces 25 are organized into sets having identifying indicia, e.g., color, for each player. The price cards 24 additionally indicate the price of additional movable game pieces 21 and a finance charge.

Referring again to FIG. 3, a set of playing cards 26 is provided, each of which bears indicia setting forth an action requirement. The playing cards 26 include a set of Ocean cards 26*a* and a set of Docking cards 26*b*. The ocean cards 26*a* direct the player to move in a particular direction on the playing surface 12 (i.e, to move forward or backward one segment 14), to pay or receive a given amount of currency 22, in the form of "taxes," "expenses" or a "reward," to select a new price card 24, or to initiate a "lawsuit." Docking cards 26*b* direct the player to "pay taxes," "pay expenses," purchase fuel, receive a "reward," select a new price card 24, or initiate a lawsuit.

A presently preferred manner of play of this embodiment is as follows. Each player is given $200 in currency 22 and one movable game piece 21 depicting a ship of his or her choice, either an oil tanker, a container ship or a freighter. The price cards 24 are shuffled and the top card is turned face up to reveal the value of the individual product items and static game pieces 25. This price card 24 remains in effect until a player is directed to turn over the next price card 24, either by the spinner 16 ending on a segment 17*c* marked "Price card" or by drawing a playing card 26 which requires a new Price card to be put in play. Players may purchase additional movable game pieces 21 or static game pieces 25 at any time; it is not necessary to wait for that player's turn.

The first player spins the spinner 16 and moves his or her ship in any direction across the playing surface 12 the number of segments indicated on the spinner 16. When a player's turn ends without the player reaching a landmass, that player must take an ocean card 26*a* and then must take the action specified thereon, which may require the player to move forward or backward a space on the playing surface 12, or may direct the player to take a new price card 24, pay "taxes" or "expenses," or initiate a lawsuit. The game continues in this manner, alternating turns among the players until one player concludes his or her turn by landing on a segment adjacent a landmass. The player is then said to be "in docking."

A player in docking may purchase product items, provided the player has first purchased and emplaced a static game piece 25, i.e., a bank or building, in the country in which the player wishes to purchase a product item. If the player has previously emplaced a static game piece 25 in the country on which that player has landed, the player may purchase oil, goods or freight by transferring the amount of currency indicated by the price appearing on the current price card 24 to the "box", where undistributed currency is kept. After purchasing a product item, the player places a peg 23 in his or her ship to signify that the vessel is "loaded." The player concludes his or her turn by drawing a docking card 26*b* and taking the action specified thereon, i.e., paying taxes, buying fuel, etc.

If a player concludes a turn in a country in which that player has not previously placed a static game piece 25, but in which another player has placed a static game piece 25, the player without a static game piece 25 in that area must pay the other player an amount of currency set by the finance figure indicated on the price card 24. If both players have previously placed static game pieces 25 on that area, no currency is transferred.

Having purchased a product item, the player then proceeds as above to move his or her ship to a different country in which to sell the product item. When the player concludes his or her turn on a segment adjacent (contiguous with) a landmass, the player may sell the product item, removing currency from the box of undistributed currency, at the price indicated by the price card 24 provided that player has previously emplaced a static game piece 25, i.e., a bank or building, in that country. After a player sells the product item, the player removes the peg 23 from his or her ship to indicate that the ship is "empty."

When a player draws a playing card 26 that bears the legend "LAWSUIT," or when the spinner ends on a segment 17*a* or 17*b* labeled "LAWSUIT," that player may initiate a lawsuit against another player of his or her choice. The player initiating the lawsuit is the "plaintiff" and the chosen player is the "defendant." The players involved in the lawsuit each spin the spinner 16 once. If the "plaintiff" receives a higher number, he or she may collect from the "defendant" $10 for every static game piece 25 owned by the "plaintiff." If the "defendant" receives a higher number, the lawsuit has been successfully defended against, and no currency is transferred.

Players may sell movable game pieces 21, i.e., ships, or static game pieces 25, e.g., banks and buildings, by removing them from the playing surface 12, and receiving an amount of currency equal to half the amount indicated on the price card 24. The game continues until all of the undistributed currency in the box is exhausted, until a predetermined time limit expires, until all of the players except one have exhausted their currency, or until a predetermined sum or collection of assets by one player is amassed.

While the game board arrangement of this invention has been described in connection with a certain presently preferred embodiment, it will be immediately obvious to those skilled in the art that there may be many modifications of structure, arrangement, portions, elements, materials and components used in the practice of the invention which are particularly adapted for specific applications without departing from the principles of this invention.

What is claimed is:

1. A board game device comprising:

a game board having a playing surface, the playing surface having formed thereon a depiction of a plurality of landmasses separated from each other by oceanic expanses, said oceanic expanses being divided into contiguous segments constituting discrete movement spaces in the play of the game, a plurality of movable game pieces for movement over said playing surface, said game pieces being organized into sets bearing an identifying indicium for each set, a set of currency each bearing an indicium of value, a random number generator, a set of price cards each bearing varying indicia setting forth a value for a predetermined plurality of items, including product items, a marker indicative of a product item, a set of playing cards bearing varying indicia setting forth an action requirement, said playing cards being related in use to certain areas of said playing surface, a set of static game pieces representing edifices emplaceable on a landmass in accordance with an exchange of currency related to a price card, a movable game piece being advanced about said oceanic expanses in accordance with a random number generated by said random number generator, a playing card being selected from said set when a movable game piece lands upon one of said certain areas, each said marker being associateable with a movable game piece upon movement of a movable game piece to a segment adjacent to a landmass having an edifice emplaced thereon, with said marker being so associateable with a movable game piece in accordance with an exchange of currency related to a price card, said marker thereafter being disassociateable with a movable game piece upon movement of that movable game piece to a segment adjacent to a landmass having an edifice emplaced thereon in accordance with an exchange of currency related to a price card.

2. A board game device comprising:

a game board having a playing surface, the playing surface having formed thereon a depiction of a plurality of differently identified landmasses separated from each other by oceanic expanses, said oceanic expanses being divided into contiguous segments constituting discrete movement spaces in the play of the game, a plurality of movable game pieces representing ships for movement over said playing surface, said game pieces being organized into sets bearing an identifying indicium for each set, a set of currency each bearing an indicium of value, a random number generator, a set of price cards each bearing varying indicia setting forth a value for a predetermined plurality of items, including product items, with at least some of said product item values being different as between identified landmasses, a marker indicative of a product item, a set of playing cards bearing varying directions setting forth an action requirement, said playing cards being related in use to certain areas of said playing surface, a playing card being selected from said set when a movable game piece lands upon one of said certain areas, a plurality of static game pieces representing edifices emplaceable on a landmass in accordance with an exchange of currency related to a price card, said static game pieces being organized into sets bearing an identifying indicium for each set, a movable game piece being advanced about said oceanic expanses in accordance with a random number generated by said random number generator, each said marker being associateable with a movable game piece upon movement of a movable game piece to a segment adjacent to a landmass having an edifice emplaced thereon, with said marker being so associateable with a movable game piece in accordance with an exchange of currency related to a price card, said marker thereafter being disassociateable with a movable game piece upon movement of that movable game piece to a segment adjacent to a landmass having an edifice emplaced thereon in accordance with an exchange of currency related to a price card.

3. The game board device of claim 2 wherein said price cards bear values for product items denominated "oil" "freight" and "goods," and for other items denominated "ships" "buildings" "banks" and "finance", and wherein said plurality of static game pieces represent buildings and banks.

4. The game board device of claim 3 wherein said set of playing cards bearing varying directions setting forth an action requirement includes a set of ocean cards from which an ocean card is selected upon conclusion of movement of a movable game piece on a segment which is not contiguous with a landmass, and a set of docking cards from which a docking card is selected upon conclusion of movement of a movable game piece on a segment which is contiguous with a landmass.

5. The game board device of claim 4 wherein said random number generator includes indicia respectively representing "lawsuit" and "price card" actions, said lawsuit action comprising an exchange of currency between selected game players based upon a predetermined mode of lawsuit outcome determination which is further related to said static game pieces, and said price card action comprising selection of a new price card from said set of price cards.

6. The game board device of claim 5 wherein at least one of said ocean card and docking card sets includes cards bearing indicia respectively representing said lawsuit and price card actions.

7. A game board device comprising:

a game board;

a playing surface depicting a map of the world formed on the game board, upon which is superimposed a gridwork of contiguous segments defining paths of movement;

a plurality of sets of movable game pieces, each of said sets bearing identifying indicia to allow each player to identify his or her movable game pieces, said movable game pieces representing ships engaged in intercontinental trade, to be moved along said paths of movement;

a plurality of static game pieces that players may purchase and emplace on a landmass of the playing surface;

a set of currency bearing indicia of value, with which players buy and sell additional static and movable game pieces and product items to be shipped between landmasses of the playing surface; markers indicative of a product item to be carried on a movable game piece after purchasing a product item;

a random number generator that determines the number of units of movement that make up a given player's turn;

a plurality of sets of playing cards that bear indicia setting forth an action requirement to be employed when movement of a movable game piece concludes on a segment bearing indicia corresponding to one of the said sets of playing cards;

and a set of price cards that each bear indicia for setting the varying value of product items, additional movable game pieces and static game pieces, and a finance charge.

* * * * *